US012575672B2

(12) United States Patent
Deng et al.

(10) Patent No.: US 12,575,672 B2
(45) Date of Patent: Mar. 17, 2026

(54) COMBINED CABINET

(71) Applicant: Xulin Deng, Shanghai (CN)

(72) Inventors: Xulin Deng, Shanghai (CN); Xuesong Deng, Urumqi (CN)

(73) Assignee: Xulin Deng (CN)

( * ) Notice: Subject to any disclaimer, the term of this patent is extended or adjusted under 35 U.S.C. 154(b) by 610 days.

(21) Appl. No.: 17/925,077

(22) PCT Filed: Mar. 12, 2021

(86) PCT No.: PCT/CN2021/080424
§ 371 (c)(1),
(2) Date: Nov. 14, 2022

(87) PCT Pub. No.: WO2021/227637
PCT Pub. Date: Nov. 18, 2021

(65) Prior Publication Data

US 2023/0189990 A1 Jun. 22, 2023

(30) Foreign Application Priority Data

May 15, 2020 (CN) ..... 202010412655.5
May 15, 2020 (CN) ..... 202020809809.X

(51) Int. Cl.
*A47B 87/02* (2006.01)
*A47B 87/00* (2006.01)
*A47F 3/02* (2006.01)

(52) U.S. Cl.
CPC ..... *A47B 87/0276* (2013.01); *A47B 87/005* (2013.01); *A47F 3/02* (2013.01)

(58) Field of Classification Search
CPC . A47B 87/0276; A47B 87/005; A47B 47/047; A47B 87/02; A47B 87/0207;
(Continued)

(56) References Cited

U.S. PATENT DOCUMENTS 2,325,363 A * 7/1943 Blake ..... A47F 1/10 221/130
4,287,992 A * 9/1981 Takemori ..... A47F 1/087 312/45
(Continued)

FOREIGN PATENT DOCUMENTS

CN 2768584 Y 4/2006
CN 201683391 U 12/2010
(Continued)

OTHER PUBLICATIONS

Office Action issued in counterpart Chinese Application No. 202010412655.5 on Oct. 23, 2024.
(Continued)

*Primary Examiner* — Hiwot E Tefera
(74) *Attorney, Agent, or Firm* — The Belles Group, P.C.

(57) ABSTRACT

A combined cabinet is formed by assembling single cabinets. Every two adjacent single cabinets can be communicated with each other by means of a first port, and goods in each single cabinet can enter an adjacent single cabinet by means of the first port. The combined cabinet is further provided with a storage board, a drive element, an automatic door, and an adjustment board in each single cabinet. The drive element is used for pushing the goods to leave the storage board, the adjustment board is used for guiding the goods, and the automatic door is used for opening or closing the first port. The combined cabinet can be designed to be fan-shaped, spherical, crushed stone-like, stacked, corner-like, etc.

19 Claims, 17 Drawing Sheets

(58) Field of Classification Search
CPC .... A47F 3/02; A47F 1/087; A47F 1/08; A47F 1/04; A47F 1/126; A47F 1/12; A47F 1/125; G07F 11/34; G07F 11/16
See application file for complete search history.

(56) References Cited

U.S. PATENT DOCUMENTS

| | | | | |
|---|---|---|---|---|
| 4,586,633 | A * | 5/1986 | Holland | G07F 11/34 211/49.1 |
| 4,834,263 | A * | 5/1989 | Becze | G07F 11/20 221/282 |
| 5,520,941 | A | 5/1996 | Oosterling | |
| 5,743,430 | A * | 4/1998 | Freixas | A47F 1/04 221/97 |
| 5,865,324 | A * | 2/1999 | Jay | A47F 7/28 211/74 |
| 6,015,051 | A * | 1/2000 | Battaglia | A47F 1/126 211/59.3 |
| 2004/0007546 | A1* | 1/2004 | Stinnett | A47F 1/08 211/194 |
| 2008/0067188 | A1* | 3/2008 | White | G07F 11/10 221/123 |
| 2010/0116758 | A1* | 5/2010 | Noble Colin | A47B 87/0276 211/1 |
| 2011/0006074 | A1 | 1/2011 | Machers | |
| 2013/0002099 | A1* | 1/2013 | Jafa | A47F 3/0404 312/109 |
| 2013/0062361 | A1* | 3/2013 | Loftin | A47F 1/087 221/64 |
| 2019/0150614 | A1* | 5/2019 | McLean | A47B 81/00 |

FOREIGN PATENT DOCUMENTS

| | | | |
|---|---|---|---|
| CN | 202959686 | U | 6/2013 |
| CN | 204245733 | U | 4/2015 |
| CN | 205849099 | U | 1/2017 |
| CN | 206974109 | U | 2/2018 |
| CN | 207409054 | U | 5/2018 |
| CN | 108416915 | A | 8/2018 |
| CN | 109272650 | A | 1/2019 |
| CN | 208384699 | U | 1/2019 |
| CN | 109598846 | A | 4/2019 |
| CN | 209135957 | U | 7/2019 |
| CN | 209281539 | U | 8/2019 |
| CN | 110738792 | A | 1/2020 |
| CN | 210018479 | U | 2/2020 |
| CN | 210864939 | U | 6/2020 |
| CN | 111387759 | A | 7/2020 |
| CN | 212066201 | U | 12/2020 |
| CN | 212755011 | U | 3/2021 |
| EP | 1095878 | A1 | 5/2001 |
| JP | H0556835 | A | 3/1993 |
| JP | 2000259941 | A | 9/2000 |
| JP | 3159627 | U | 5/2010 |
| JP | 2011024768 | A | 2/2011 |

OTHER PUBLICATIONS

Office Action issued in counterpart Japanese Application No. 2022-569216 on Oct. 31, 2023.

* cited by examiner

COMBINED CABINET

This application is the national phase of International Patent Application No. PCT/CN2021/080424, titled "COMBINED CABINET", filed on Mar. 12, 2021, which claims the priority to Chinese Patent Application No. 202010412655.5, titled "COMBINED CABINET", filed with the China National Intellectual Property Administration on May 15, 2020, and this application further claims the priority to Chinese Patent Application No. 202020809809.X, titled "COMBINED CABINET", filed with the China National Intellectual Property Administration on May 15, 2020, all of which are incorporated herein by reference in their entireties.

FIELD

The present application relates to the technical field of goods storage and dispensing, and in particular to a combined cabinet.

BACKGROUND

A sales space of an existing sales cabinet is fixed. If the sales space of the sales cabinet is required to be expanded, the only way is to replace the existing sales cabinet with a larger one. If the sales space of the sales cabinet is required to be reduced, the only way is to replace the existing sales cabinet with a smaller one. However, even if the existing sales cabinet is replaced, the new sales cabinet is likely to still have the problem of being too big or too small, so it is generally impossible to get a sales cabinet of a perfect size. In order to expand the sales space of the sales cabinet, two sales cabinets may be spliced together, but there is no communication inside the two spliced sales cabinets, and the two spliced sales cabinets can only be used independently.

Therefore, how to design a combined cabinet, which is assembled by users and an interior of which is an organic whole, is a key problem that those skilled in this field need to solve urgently.

SUMMARY

An object of the present application is to provide a combined cabinet, where a user can assemble the combined cabinet meeting requirements by using multiple single cabinets, and the single cabinets are communicated with each other. In order to achieve the above object, the following technical solutions are provided according to the present application:

a combined cabinet is an assembly of single cabinets, where two adjacent single cabinets are in communication with each other through a passage opening, and goods in the respective single cabinet can enter into the adjacent single cabinet through the passage opening.

Preferably, a goods storage plate is arranged in each single cabinet, and the goods storage plate is used for carrying goods; a driving member is arranged on the goods storage plate; the passage opening includes a first passage opening, and the first passage opening is located downstream from the driving member; and the driving member is configured to push the goods off the goods storage plate, so that the goods enter the adjacent single cabinet through the first passage opening.

Preferably, the combined cabinet is formed by stacking multiple single cabinets.

Preferably, one end of the goods storage plate in each single cabinet is provided with the first passage opening, or two ends of the goods storage plate are each provided with the first passage openings.

Preferably, multiple driving members are arranged side by side.

Preferably, each single cabinet is arranged obliquely or horizontally; and the goods storage plate is arranged obliquely or horizontally.

Preferably, a front panel of each single cabinet is transparent, multiple layers of the single cabinets are combined into the combined cabinet, and the single cabinets are such arranged that the front panels of the single cabinets are flush with each other, and the front panel of each single cabinet inclines outwards from bottom to top.

Preferably, from the bottom layer to the top layer, an inclination angle of the front panel of each single cabinet gradually increases.

Preferably, a cross-section of each single cabinet is polygonal.

Preferably, a distance between the driving member and the corresponding single cabinet changes in the driving process.

Preferably, a distance between the driving member and the corresponding front panel is constant in the driving process.

Preferably, an adjusting plate is arranged in each single cabinet, and the adjusting plate is located downstream from the corresponding driving member and is hinged on the corresponding single cabinet, where the adjusting plate can guide the falling goods into the corresponding first passage opening, and the adjusting plate can also adjust the falling speed of the goods by adjusting its own inclination angle.

Preferably, two or more combined cabinets are arranged, two adjacent combined cabinets are communicated with each other, and the adjusting plate can also guide the falling goods into the adjacent combined cabinet.

Preferably, the adjusting plate is hinged on the corresponding single cabinet through a universal joint.

Preferably, each single cabinet has a cone structure.

Preferably, the combined cabinet is fan-shaped or spherical.

Preferably, each single cabinet is polyhedral, and in two adjacent single cabinets, one side plate of one single cabinet is attached to one side plate of the other single cabinet, and the two adjacent single cabinets are communicated with each other through the first passage opening.

Preferably, each single cabinet is gravel-shaped, and multiple single cabinets are combined into a gravel-shaped combined cabinet.

Preferably, a cabinet door is arranged on the front panel of each single cabinet.

Preferably, the cabinet door is a transparent glass door or an opaque door.

Preferably, the combined cabinet is a corner-shaped combined cabinet and includes an upper row cabinet and a lower row cabinet, where the upper row cabinet and the lower row cabinet are communicated with each other through the first passage opening, the cabinet door of the upper row cabinet is located outside the visible range of the lower row cabinet, and vice versa.

Preferably, multiple upper row cabinets are provided, and the cabinet door of each upper row cabinet is located outside the visible range of other upper row cabinets.

Preferably, multiple lower row cabinets are provided, and the cabinet door of each lower row cabinet is located outside the visible range of other lower row cabinets.

Preferably, the driving member is a push rod, a screw or a conveyor belt.

Preferably, the goods storage plate is supported by a support rod extending along a driving direction of the driving member, and the goods storage plate can move along the support rod.

Preferably, the passage opening further includes a second passage opening arranged on an extension line of the driving member, and the driving member can push the goods into the adjacent single cabinet through the second passage opening.

Preferably, an automatic shutter is provided at the first passage opening, and the automatic shutter is configured to open or close the first passage opening.

Preferably, the automatic shutter is hinged at the first passage opening, and further plays a guiding role for goods passing through the first passage opening.

Preferably, a middle part of the automatic shutter is hinged in the first passage opening, and one side of the automatic shutter is hinged to one side of the first passage opening.

Preferably, the combined cabinet is a regular body or an irregular body.

It can be seen from the above technical solutions that users can assemble the combined cabinet according to specific capacity requirements. Different capacity requirements can be met by increasing or decreasing the number of single cabinets. Moreover, the adjacent single cabinets can communicate with each other through the passage opening, so that the stored goods can be transferred from the designated single cabinet, thus facilitating goods fetching. Secondly, according to the requirements of the site and customers, the combined cabinet can be designed as fan-shaped, spherical, gravel-shaped, stacked, corner-shaped, etc. In addition, the combined cabinet assembled from the single cabinets in this application may also be used as a partition wall or an artistic decoration.

BRIEF DESCRIPTION OF THE DRAWINGS

In order to more clearly illustrate technical solutions of the embodiments of the present application, the drawings used in the description of the embodiments are briefly described below. It is apparent that the drawings in the following description show only some embodiments of the present application, and other drawings may be obtained by those skilled in the art based on the illustrated drawings without any creative efforts.

Figure 1:
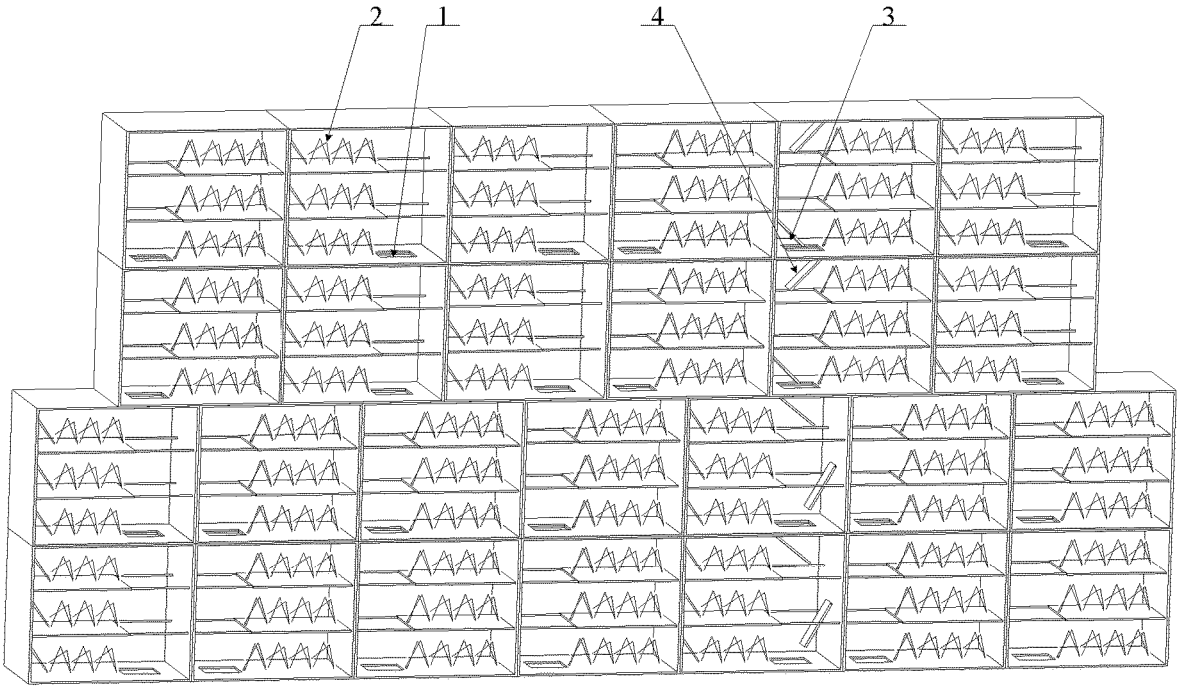
FIG. 1 is a schematic diagram of a combined cabinet assembled from rectangular parallelepiped single cabinets provided by a specific embodiment of the present application.

| Reference numerals in the drawings: | |
|---|---|
| 1 first passage opening, | 2 driving member, |
| 3 adjusting plate, | 4 automatic shutter, |
| 5 goods storage plate, | 6 support rod, |
| 7 front panel, | 8 universal joint, |
| 9 second passage opening, | 10 upper row cabinet, |
| 11 lower row cabinet. | |

DETAILED DESCRIPTION OF THE EMBODIMENTS

A combined cabinet is disclosed according to the present application, where a user can assemble the combined cabinet meeting requirements by using multiple single cabinets, and the single cabinets are communicated with each other.

Technical solutions in the embodiments of the present application are clearly and completely described hereinafter in conjunction with the drawings in the embodiments of the present application. Apparently, the embodiments described in the following are only some embodiments of the present application, rather than all embodiments. Any other embodiments obtained by those skilled in the art based on the embodiments in the present application without any creative effort shall fall within the protection scope of the present application.

In description of the present application, it should be understood that an orientation or a position relation indicated by terms such as "upper", "lower", "left", "right" or the like is described based on an orientation or a position relation shown in the drawings, and is only used for describing the present application and simplifying the description, rather than instructing or implying that a device or element related to the terms has a specific orientation or is constructed and operated in a specific orientation. Therefore, the terms should be not construed as limitations to the present application.

The combined cabinet in the present application is an assembly of single cabinets. Two adjacent single cabinets can be communicated with each other through a first passage opening 1. Goods in the respective single cabinet can enter into the adjacent single cabinet through the first passage opening 1. Therefore, the interior of the combined cabinet is a communicated whole. Users can assemble the combined cabinet according to specific capacity requirements. Different capacity requirements can be met by increasing or decreasing the number of single cabinets. Moreover, the adjacent single cabinets can communicate with each other through the first passage opening 1, so that the stored goods can be transferred from the designated single cabinet, thus facilitating goods fetching.

Furthermore, a goods storage plate 5 is arranged in each single cabinet, and the goods storage plate 5 is used for carrying goods. A driving member 2 is arranged on the goods storage plate 5. The passage opening includes a first passage opening 1. The first passage opening 1 is located downstream from the driving member 2. The driving member 2 is configured to push the goods on the goods storage plate 5 off the goods storage plate 5, so that the goods enter the next single cabinet through the first passage opening 1 under the action of gravity. The combined cabinet in this application is described in detail in the following with reference to specific embodiments.

First Embodiment

The combined cabinet is formed by stacking multiple single cabinets. That is, the combined cabinet in this embodiment formed by stacking the single cabinets layer by layer. Referring to FIG. 1 to FIG. 16, FIG. 1 to FIG. 16 all belong to the combined cabinet formed by stacking.

The single cabinets can be arranged horizontally or obliquely. If the single cabinets are inclined, the combined cabinet formed thereby is in the form shown in FIG. 12. This arrangement is suitable for inclined spaces or artistic decorations. It can be seen from FIG. 12 that if the goods in the single cabinet of the highest layer are to be taken out, the driving member 2 in the single cabinet of the highest layer can drive the goods to move obliquely downward and then fall onto the goods storage plate 5 of the single cabinet of the intermediate layer. Then, the driving member 2 in the single cabinet of the intermediate layer drives the goods to move obliquely downward and enter the single cabinet of the lowest layer through the first passage opening 1. Finally, driven by the driving member 2 in the single cabinet of the lowest layer, the goods are moved out from the first passage opening 1 of the single cabinet of the lowest layer. It should be noted that, in this embodiment, the goods storage plate 5 is inclined, and in order to prevent the goods from sliding down undesirably, the driving member 2 can be a spiral push rod. In a natural state, the goods are stuck in a spiral structure of the spiral push rod. When the goods need to be moved, the spiral push rod rotates for one circle, and the goods are pushed by a pitch distance.

The goods storage plate is arranged obliquely or horizontally. If red wine is to be placed, it is necessary to select an inclined goods storage plate to place red wine so that the oak stopper can be immersed in red wine.

Figure 13:
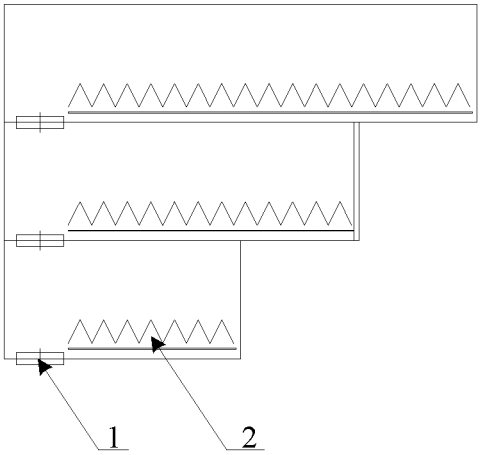
FIG. 13 is a schematic structural diagram of a left-justified combined cabinet provided by a specific embodiment of the present application.
Figure 14:
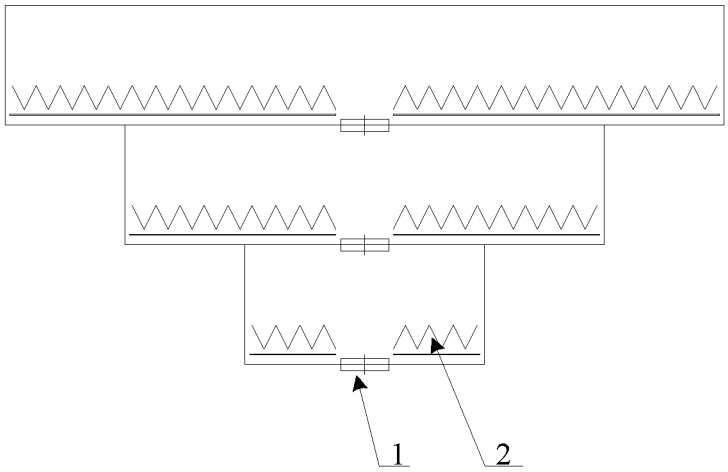
FIG. 14 is a schematic structural diagram of a middle justified combined cabinet provided by a specific embodiment of the present application.

The size of the single cabinet is variable. Reference can be made to FIG. 13 to FIG. 14. In FIG. 13, a volume of each single cabinet gradually increases from bottom to top, and the single cabinets are left-justified. The first passage openings 1 of the layers are vertically aligned. If it is required to obtain the goods in the single cabinet of the highest layer, all the first passage openings 1 in the three layers of single cabinets are opened, the driving member 2 in the single cabinet of the highest layer drives the goods towards the corresponding first passage opening 1, so that the goods are moved out through the three first passage openings 1 in turn. In FIG. 14, the volume of each single cabinet gradually increases from bottom to top, and the single cabinets are middle-justified. In addition, the first passage opening 1 is arranged in the middle of the single cabinet of each layer. Then the left and right driving members 2 can drive the goods towards the middle, so that the goods can move through the first passage opening 1. The specific process is not repeated here.

Figure 15:
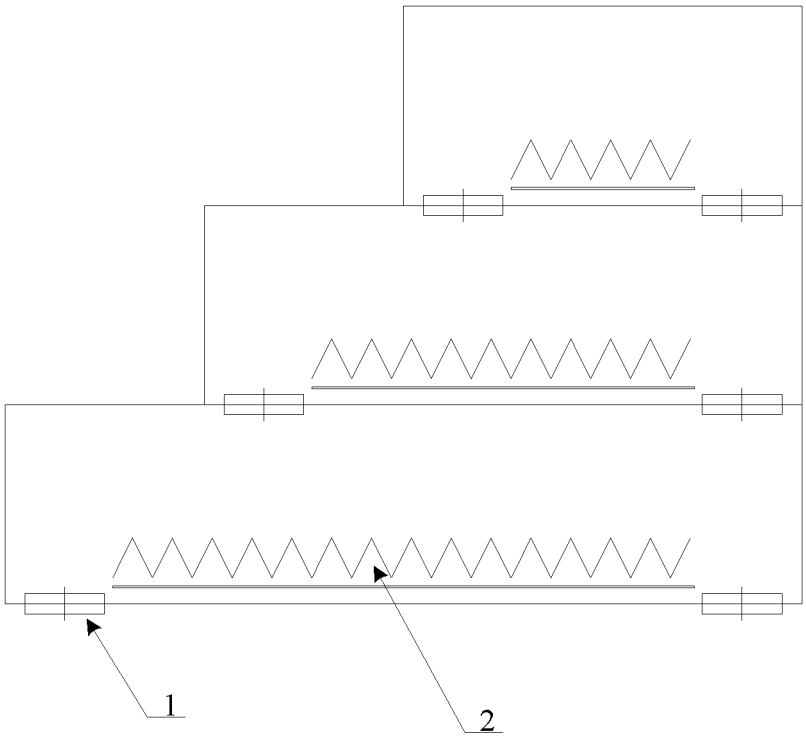
FIG. 15 is a schematic structural diagram of a right-justified combined cabinet provided by a specific embodiment of the present application.

In FIG. 15, the volume of each single cabinet gradually decreases from bottom to top, and the single cabinets are right-justified. In addition, it should be noted that, in FIG. 15, the left and right sides of the driving member 2 are each provided with the first passage opening 1, that is, two first passage openings for each single cabinet are provided. In this way, the driver 2 can drive the goods to the left and right sides, so that the goods can be moved out. The configurations of the single cabinet of the intermediate layer being the largest or smallest, one first passage opening 1 or two first passage openings 1 or multiple first passage openings 1 being provided in the single cabinet of each layer, and the single cabinets of the layers being misaligned with each other belong to the variants based on FIG. 13 to FIG. 15, and all fall within the protection scope of "the combined cabinet formed by stacking multiple single cabinets" in this application.

Figure 16:
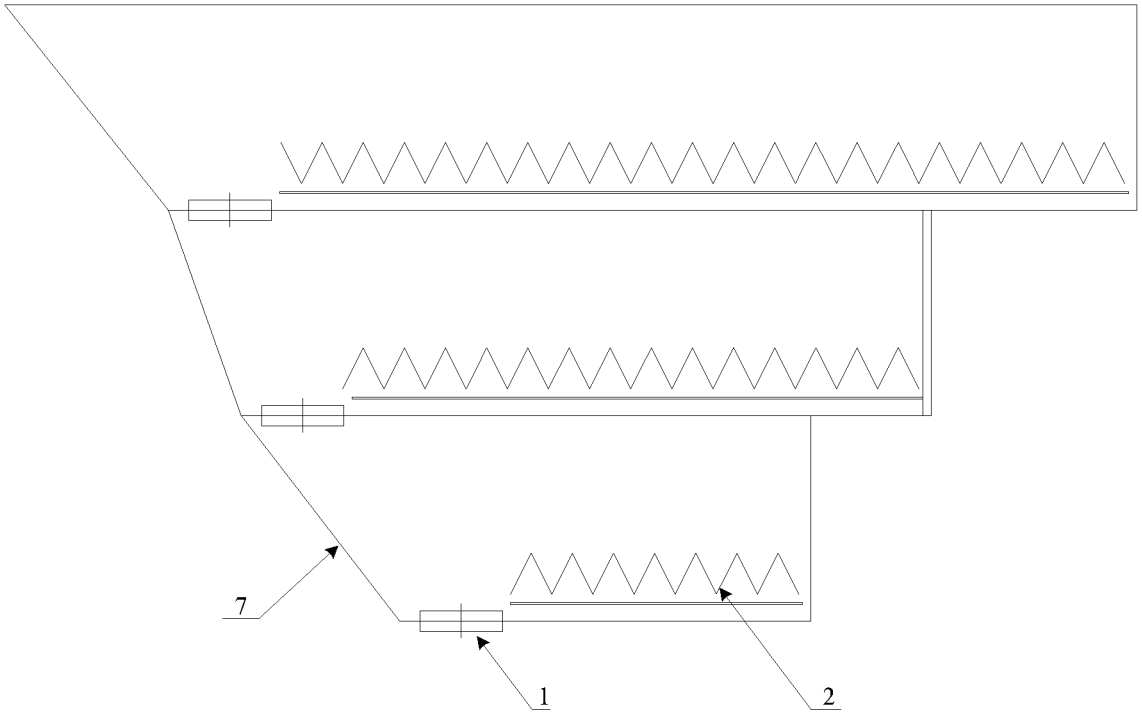
FIG. 16 is a schematic structural diagram of another combined cabinet assembled from single cabinets having obliquely arranged front panels provided by a specific embodiment of the present application.
Figure 17:
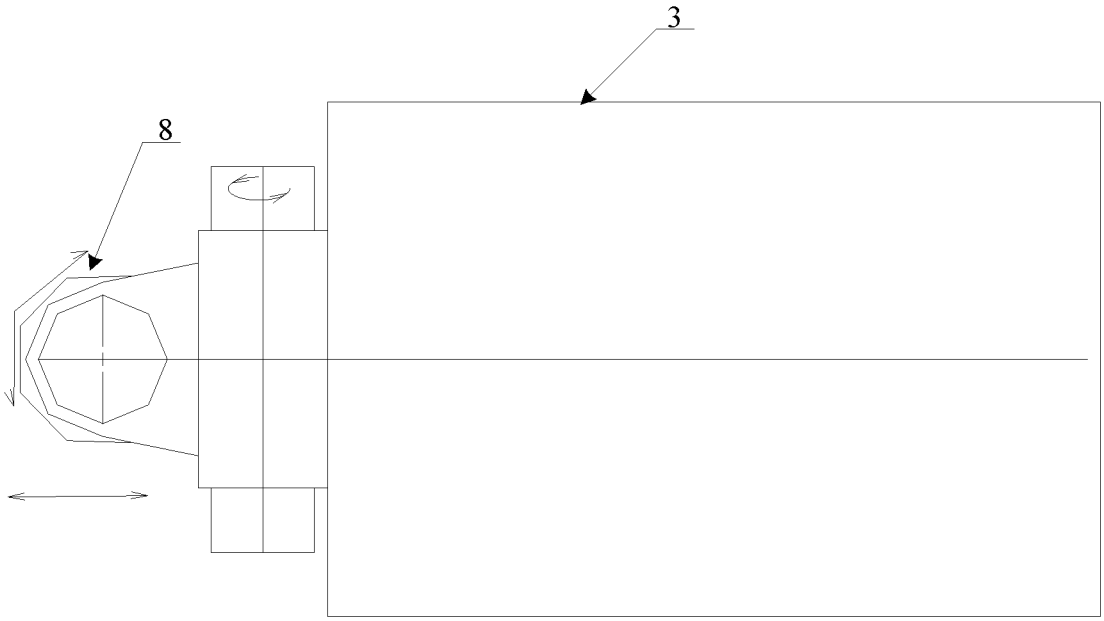
FIG. 17 is a schematic diagram showing the connection of an adjusting plate provided by a specific embodiment of the present application.

Further, the front panel of each single cabinet can be transparent, which is convenient for customers to observe the goods in the single cabinet through the front panel. If private or important goods are stored in the single cabinet, the front panel can be opaque. It should be noted here that the "front panel" mentioned in this specification refers to the end panel facing customers in the single cabinet. Referring to FIG. 16, the combined cabinet of FIG. 16 is a three-layer cabinet. The three layers of single cabinets are aligned to the left. A left side of the three layers of single cabinets is the side with the front panel. Therefore, the three layers of single cabinets are aligned to the side with the front panel. In addition, the front panel of the single cabinet on each layer is inclined outward from bottom to top. Preferably, the inclination angle of the front panel gradually increases from the lowest layer to the highest layer. With this arrangement, it is convenient for customers to observe the goods in the single cabinet from bottom to top. In addition, when the goods in the single cabinet of a higher layer are transferred to the single cabinet of a lower layer, the goods can slide along the inclined front panel, thus ensuring the movement stability of goods.

Figure 2:
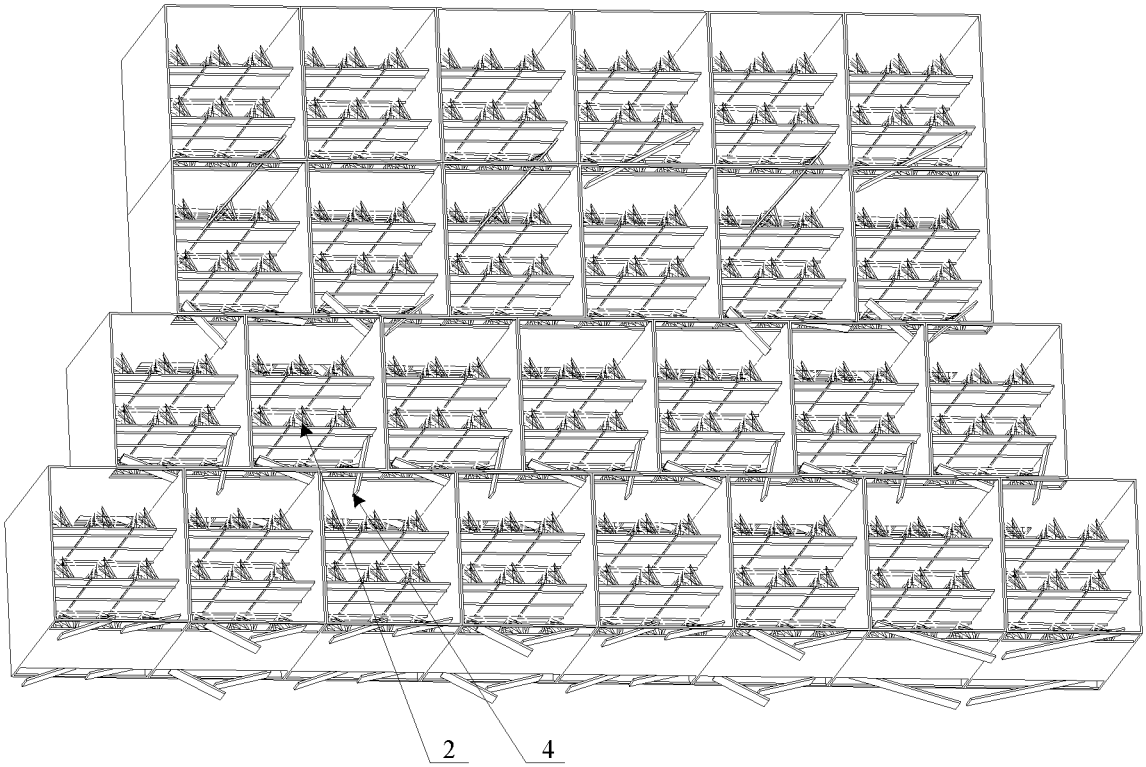
FIG. 2 is a schematic diagram of another combined cabinet assembled from rectangular parallelepiped single cabinets provided by a specific embodiment of the present application.
Figure 8:
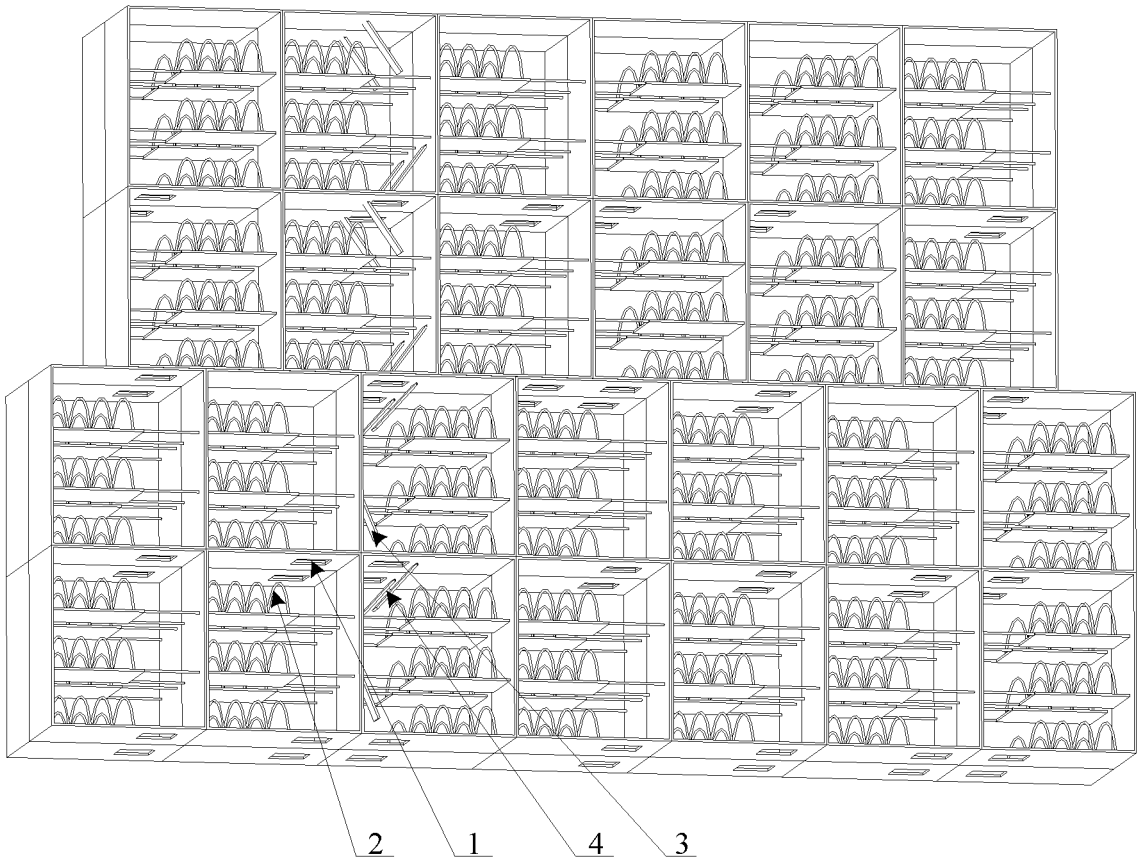
FIG. 8 is a schematic diagram of another double-sided combined cabinet assembled from rectangular parallelepiped single cabinets provided by a specific embodiment of the present application.
Figure 9:
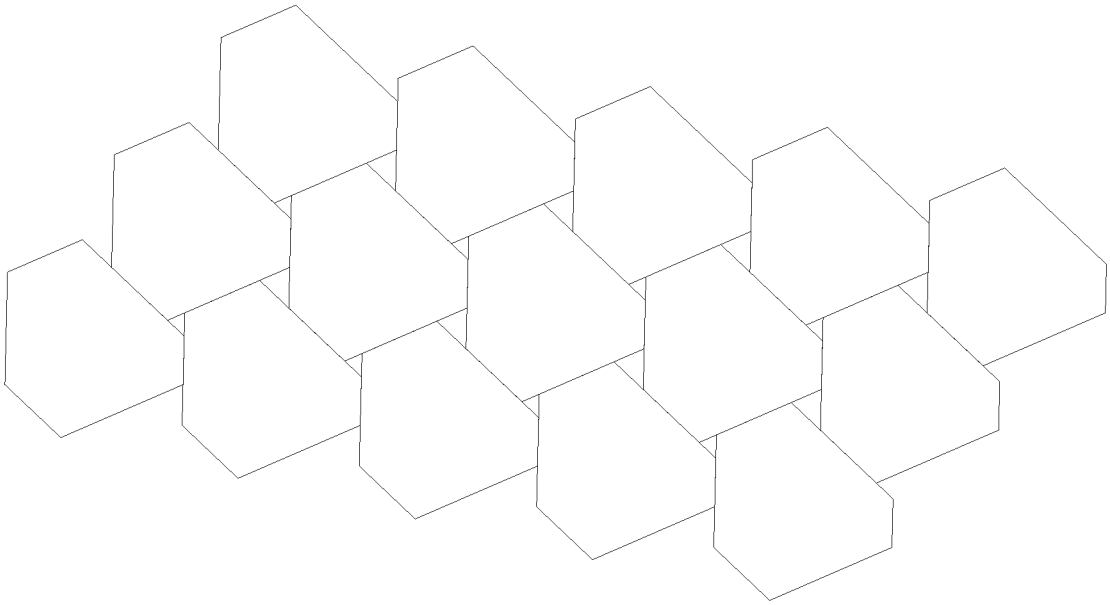
FIG. 9 is a schematic diagram of another combined cabinet assembled from single cabinets with an irregular hexagonal cross-section provided by a specific embodiment of the present application.
Figure 10:
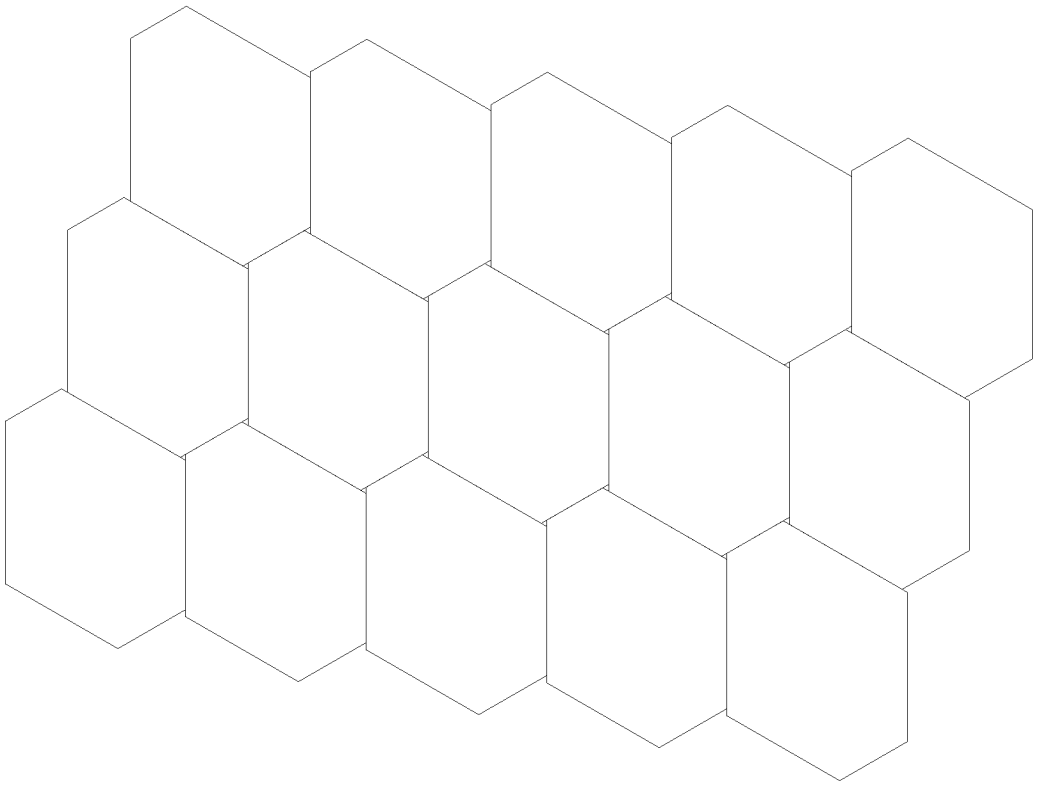
FIG. 10 is a schematic diagram of another combined cabinet assembled from single cabinets with an irregular hexagonal cross-section provided by a specific embodiment of the present application.
Figure 11:
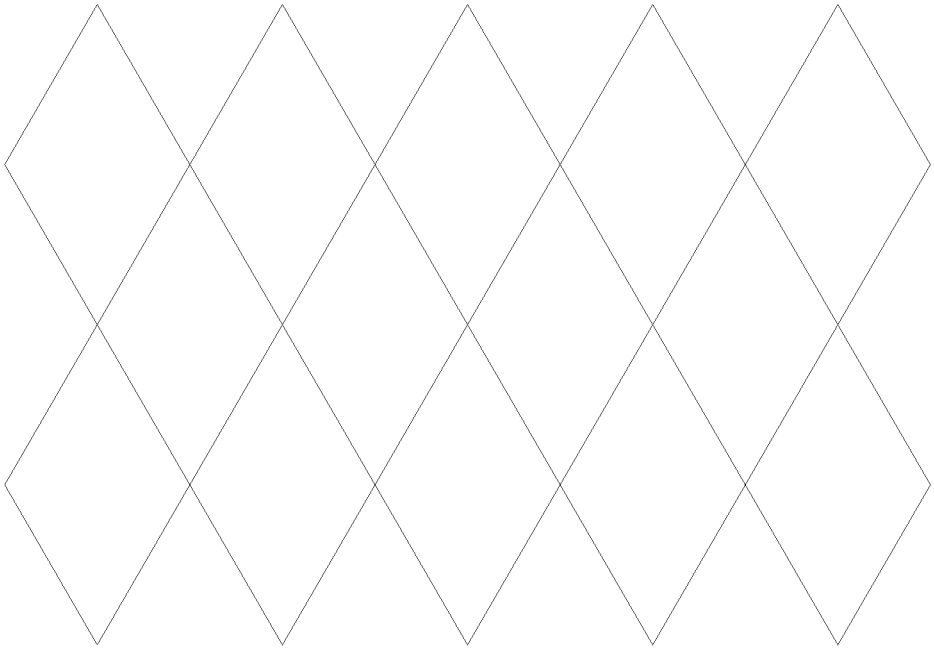
FIG. 11 is a schematic diagram of another combined cabinet assembled from single cabinets with a diamond cross-section provided by a specific embodiment of the present application.
Figure 12:
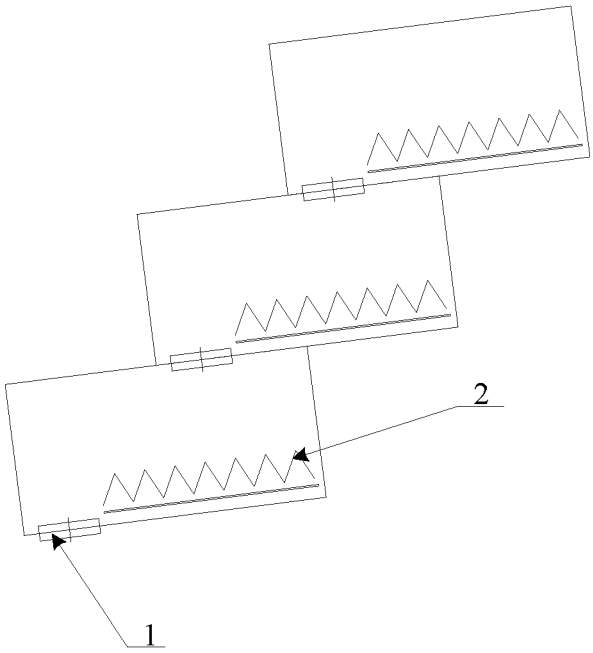
FIG. 12 is a schematic diagram of another combined cabinet assembled from obliquely placed single cabinets provided by a specific embodiment of the present application.

A cross-section of each single cabinet can be a polygon, including regular polygon and irregular polygon. Specifically, the cross-section can be a rectangle, as shown in FIG. 1, FIG. 8, FIG. 12, FIG. 13, FIG. 14 and FIG. 15; or a square, as shown in FIG. 2; or a diamond, as shown in FIG. 11; or a regular hexagon, as shown in FIG. 3, FIG. 4, FIG. 5 and FIG. 6; or an irregular hexagon, as shown in FIG. 9 and FIG. 10.

If the single cabinets are arranged in a matrix, a cabinet wall can be formed. The cabinet wall can be used as an ornament or a partition wall. Referring to FIG. 1 to FIG. 11, If the cross-section of each single cabinet in the matrix combined cabinet is rectangular or square, as shown in FIG. 1, FIG. 2 and FIG. 8, then a bottom plate of an upper single cabinet is attached to a top plate of a lower single cabinet. The two plates attached to each other are horizontal plates. The first passage opening 1 for goods to pass extends through the bottom plate and the top plate which are attached to each other. Goods in the upper single cabinet enter the lower single cabinet through the first passage opening 1. If the driving member 2 in each single cabinet is substantially parallel to the front panel of the single cabinet, the driving direction of the driving member is parallel to the front panel, as shown in FIG. 1 and FIG. 8. The driving member 2 in the single cabinet may also be substantially perpendicular to the front panel of the single cabinet, that is, the driving direction is perpendicular to the front panel, as shown in FIG. 2.

The combined cabinet can be a regular polyhedron or an irregular polyhedron. If the cross section of the single cabinet in the matrix combined cabinet is a regular hexagon, a diamond or an irregular hexagon, as shown in FIGS. 3 to 6, FIG. 11, FIG. 9 and FIG. 10, then the upper single cabinet is placed between two adjacent single cabinets in the lower layer. A lower left side plate of the upper single cabinet is attached to an upper right side plate of the lower left single cabinet. A lower right side plate of the upper single cabinet is attached to an upper left side plate of the lower right single cabinet. The two sets of attached plates are inclined plates, and are each provided with the first passage opening 1 extending therethrough for goods to pass through. That is, the goods in the upper single cabinet can enter the lower left single cabinet through the first passage opening 1 on the left, and can enter the lower right single cabinet through the first passage opening 1 on the right. In these matrix combined cabinets, the driving member 2 may also be substantially perpendicular or parallel to the front panel of the single cabinet. If the driving member 2 is substantially perpendicular to the front panel of the single cabinet, the driving direction is perpendicular to the front panel. If the driving member 2 is substantially parallel to the front panel of the single cabinet, the driving direction is parallel to the front panel.

In the matrix combined cabinet, the goods in any single cabinet can only be moved out from the lowest single cabinet, which is convenient for customers to fetch the goods. An upper automatic shutter 4 is arranged at the first passage opening 1. The automatic shutter 4 is used to control the opening and closing of the first passage opening 1. Customers can choose the single cabinet on the lowest layer from which the goods can be delivered out. Referring to FIG. 7, if the goods in cabinet B on the top layer are to be delivered out from cabinet H on the lowest layer, the moving path of the goods can be: B-D-H; if the goods in cabinet B on the top layer are to be delivered out from cabinet I on the lowest layer, the moving path of the goods can be: B-D-I, or B-E-I; if the goods in cabinet B on the top layer are to be delivered out from cabinet J on the lowest layer, the moving path of the goods can be: B-E-J. It should be noted that the passage opening on the single cabinet on the lowest layer is the outlet.

The automatic shutter 4 is telescopic or pivotable. In this embodiment, the automatic shutter 4 is preferably pivotable. That is, the automatic shutter 4 is hinged at the first passage opening 1. The automatic shutter 4 can open or close the first passage opening 1 when it rotates. That is, if the automatic shutter 4 rotates in one direction to block the first passage opening 1, the first passage opening 1 closed. If the automatic shutter 4 rotates in the other direction and leaves the first passage opening 1, the first passage opening 1 opened. In addition, the inclination of the automatic shutter 4 may affect the sliding speed of goods on the automatic shutter 4.

For example, if the sliding speed of goods passing through the first passage opening 1 is required to be increased, the automatic shutter 4 is pivoted to a position at a large inclination angle, and the automatic shutter 4 serves as an acceleration guide plate. If the sliding speed of goods passing through the first passage opening 1 is required to be reduced, the automatic shutter 4 is pivoted to a position at a small inclination angle, and the automatic shutter 4 serves as a deceleration guide plate. In actual use, for some fragile goods, the sliding speed of goods can be reduced. For some non-fragile goods, the sliding speed of goods can be appropriately increased.

Figure 4:
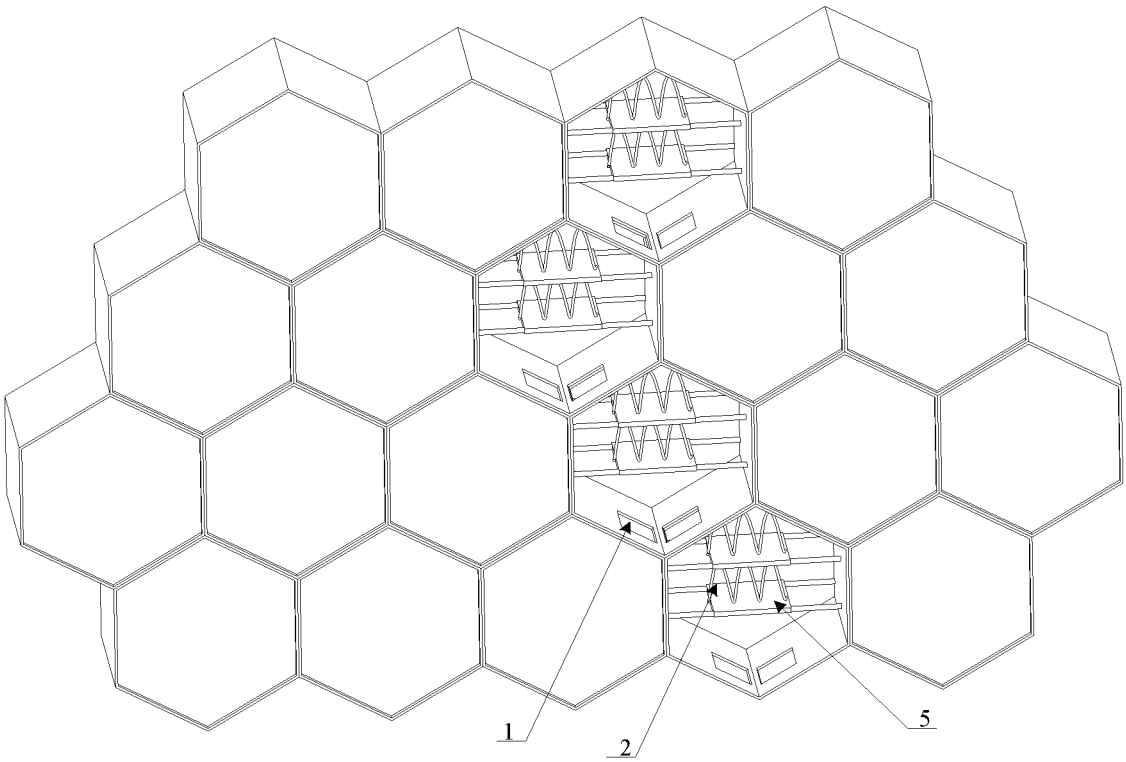
FIG. 4 is a schematic diagram of another combined cabinet assembled from single cabinets with a regular hexagonal cross-section provided by a specific embodiment of the present application.
Figure 5:
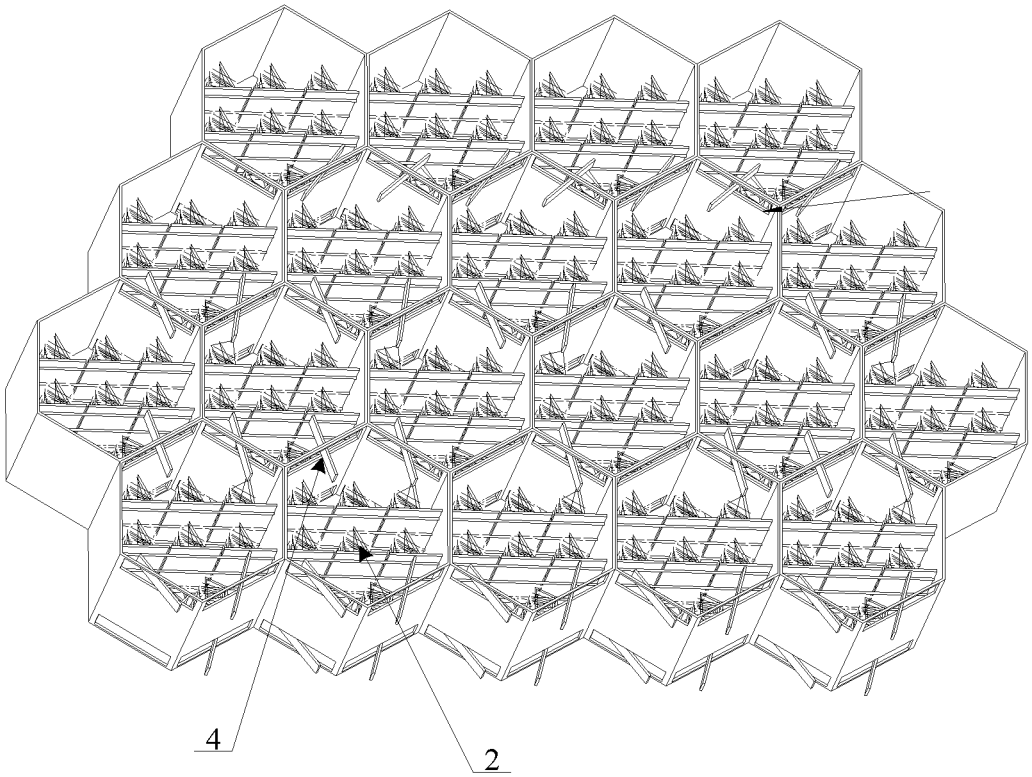
FIG. 5 is a schematic diagram of another combined cabinet assembled from single cabinets with a regular hexagonal cross-section provided by a specific embodiment of the present application.

If the driving direction of the driving member 2 in the single cabinet is perpendicular to the front panel, the first passage opening 1 located downstream from the driving member 2 can be a large one, so that the middle part of the automatic shutter 4 can be hinged in the first passage opening 1, as shown in FIG. 2 and FIG. 5. If the driving direction of the driving member 2 in the single cabinet is parallel to the front panel, the first passage opening 1 located downstream from the driving member 2 has to be a small one due to the space limitation, and the automatic shutter 4 is arranged at one side of the first passage opening 1, as shown in FIG. 1, FIG. 3, FIG. 4, FIG. 6 and FIG. 8.

In addition to fetching the goods from the single cabinet on the lowest layer, it is also possible to fetch the goods directly from the target single cabinet. For example, in this embodiment, a cabinet door is arranged on the front panel of each single cabinet. Goods can be taken out directly from the single cabinet after the cabinet door is opened. In the case that the matrix combined cabinet is used as a partition wall, those on one side of the partition wall can use the combined cabinet, and those on the other side of the partition wall can also use the combined cabinet. In addition, the cabinet doors of a part of single cabinets of the combined cabinet can open toward one side of the partition wall, and this part of single cabinets can be used by people on this side of the partition wall. The cabinet doors of another part of the single cabinets can open toward the other side of the partition wall, and this another part of the single cabinets can be used by people on the other side of the partition wall.

In addition to the above automatic shutter 4 serving as a guide plate for goods, an adjusting plate 3 can be added to further guide the goods. The adjusting plate 3 is arranged downstream from the driving member 2 and hinged to a side plate of each single cabinet. It should be noted that the "side plate" here refers to a plate that intersects the front panel in the single cabinet. After the goods are driven off the goods storage plate 5 by the driving member 2, the goods fall onto the adjusting plate 3 under the action of gravity, and then the adjusting plate 3 guides the goods into the corresponding first passage opening 1. This arrangement can ensure the smooth transfer of goods. In addition, the sliding speed of the goods can be controlled by adjusting the inclination of the adjusting plate 3.

For matrix combined cabinets, two or more combined cabinets can be assembled together. The single cabinets of one combined cabinet are communicated through the first passage opening 1, and the adjacent two combined cabinets are also communicated through the first passage opening 1. In addition, the goods are introduced into the adjacent combined cabinet through the adjusting plate 3. Referring to FIG. 8, FIG. 8 shows a two-sided matrix combined cabinet. The adjusting plate 3 faces the rear combined cabinet. If the goods driven by the driving member 2 fall on the adjusting plate 3, the adjusting plate 3 guides the goods into the rear combined cabinet.

It should be noted that the adjusting plate 3 can be hinged on the side plate of the single cabinet through a universal joint 8, as shown in FIG. 14.

Figure 3:
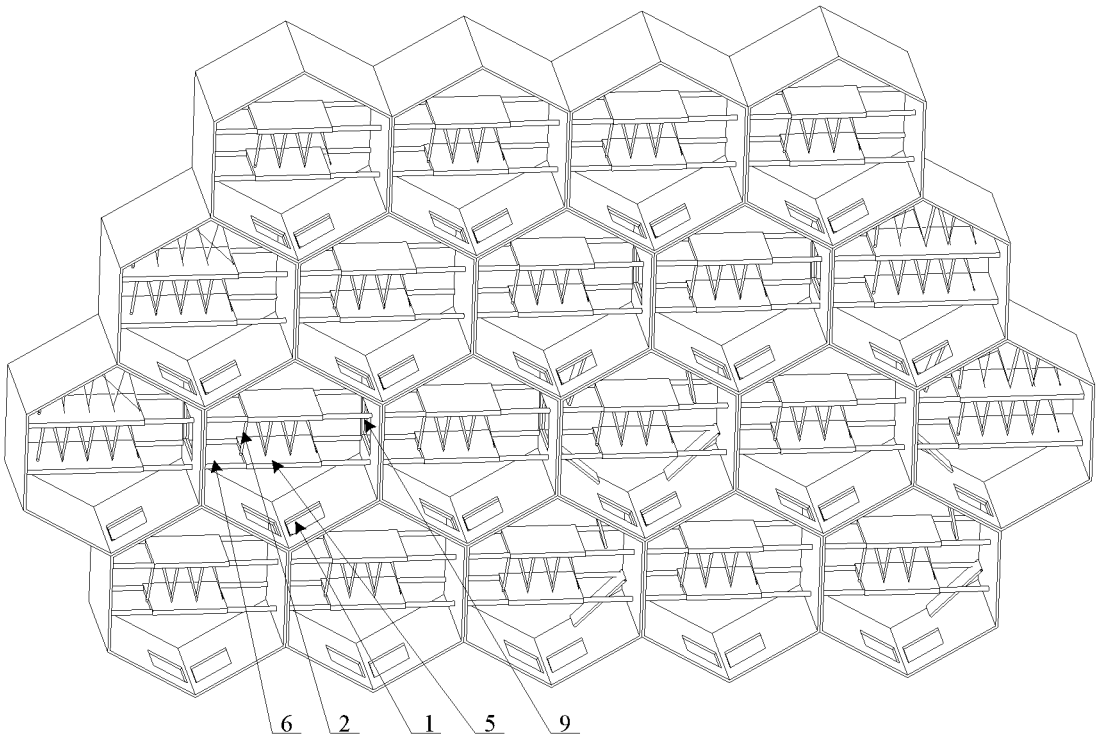
FIG. 3 is a schematic diagram of another combined cabinet assembled from single cabinets with a regular hexagonal cross-section provided by a specific embodiment of the present application.
Figure 6:
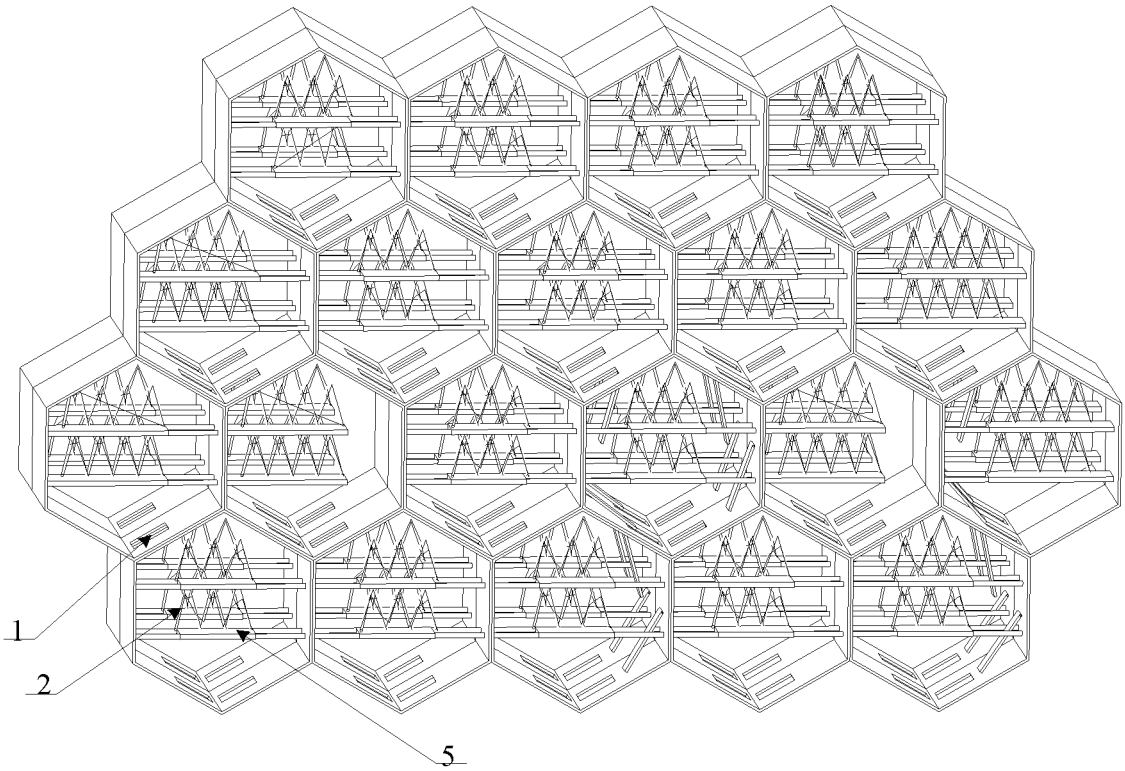
FIG. 6 is a schematic diagram of a double-sided combined cabinet assembled from single cabinets with a regular hexagonal cross-section provided by a specific embodiment of the present application.
Figure 7:
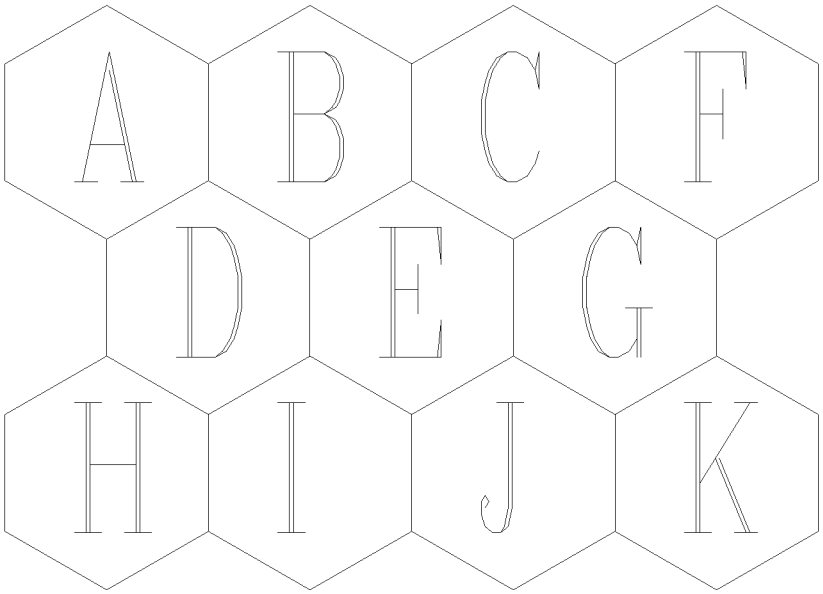
FIG. 7 is a schematic diagram of another combined cabinet assembled from single cabinets with a regular hexagonal cross-section provided by a specific embodiment of the present application.

Referring to FIG. 3, FIG. 4 and FIG. 6, the goods storage plate 5 is supported by a support rod 6, the support rod 6 extends along the driving direction of the driving member 2, and the goods storage plate 5 can move along the support rod 6. The support rod 6 is equivalent to a guide rod for the goods storage plate 5. After the goods storage plate 5 is driven by the driving device, the goods storage plate 5 moves along the support rod 6. With this arrangement, it is convenient to adjust the position of the goods storage plate 5, so that the goods on the goods storage plate 5 can smoothly pass through the first passage opening 1 on the single cabinet under drive of the driving member 2. The driving device for driving the goods storage plate 5 can be a motor, a screw rod, or a hydraulic mechanism.

Multiple goods storage plates 5 may be arranged vertically along the gravity direction, as shown in FIG. 3, FIG. 4 and FIG. 6, so as to further meet different requirements of users. In addition, the user can set the types of goods stored in each goods storage plate 5 according to requirements. For example, the freshest goods are stored on the goods storage plate 5 of the first layer, relatively fresh goods are stored on the goods storage plate 5 of the second layer, and goods almost expiring are stored on the goods storage plate 5 of the third layer. As time goes by, if goods on the goods storage plate 5 of the first layer are not sold, and the freshest goods become relatively fresh goods, then the just-turned relatively fresh goods can be automatically transferred from the goods storage plate 5 of the first layer to the goods storage plate 5 of the second layer. The specific operation is as follows: the goods storage plate 5 of the second layer is driven to move out, and then the driving member 2 on the goods storage plate 5 of the first layer pushes the goods on the goods storage plate 5 of the first layer onto the goods storage plate 5 of the second layer, and then the goods storage plate 5 of the second layer retracts to reset.

The passage includes a first passage opening 1 and a second passage opening 9. The second passage opening 9 is arranged on the extension line of the driving member. The goods on the goods storage plate can be driven by the driving member to enter the adjacent single cabinet through the second passage. For the combined cabinet having a matrix arrangement, if the driving direction of the driving member in the combined cabinet is along the lateral direction, the second passage opening 9 is configured to communicate two adjacent single cabinets in the lateral direction. Goods on the goods storage plate in the left single cabinet can enter the goods storage plate of the right single cabinet through the second passage opening 9 under drive of the driving member. In this embodiment, the single cabinets on the same layer are communicated with each other. In this way, the outflow path of goods becomes more diversified. In addition, the goods storage plate can enter the adjacent single cabinet through the second passage opening 9 under drive of the driving device, that is, the goods storage plate can move between the single cabinets on the same layer.

Further, multiple driving members 2 may be provided side by side, that is, in the same horizontal plane, there are multiple driving members 2 arranged side by side. Correspondingly, multiple goods storage plates 5 are also provided side by side to meet more requirements of users, as shown in FIG. 2 and FIG. 5.

It should be noted that the driving member 2 may be a push rod. The push rod may be a spiral push rod, a telescopic rod driven by a screw rod, a telescopic rod driven by a driving chain, or a conveyor belt. There is no specific limitation on the structure of the push rod in this specification, as long as the push rod can push the goods on the goods storage plate 5 off the goods storage plate 5. Any appropriate structure of the push rod falls into the scope of protection of this specification.

Second Embodiment

Figure 18:
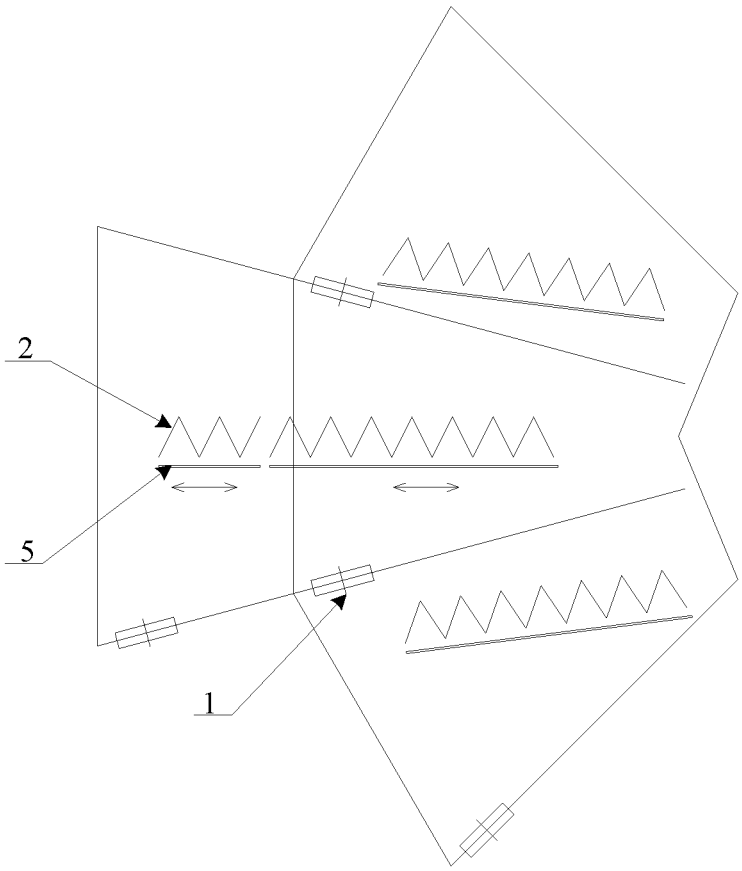
FIG. 18 is a schematic diagram of a fan-shaped combined cabinet provided by a specific embodiment of the present application.

Each single cabinet may have a cone structure. Single cabinets with a cone structure can be combined into a fan shape, as shown in FIG. 18. Each side single cabinet is communicated with the middle single cabinet through the first passage opening 1. Goods in the side single cabinet can enter the middle single cabinet through the first passage opening 1, and goods in the middle single cabinet can enter the other side single cabinet through the first passage opening 1.

Figure 19:
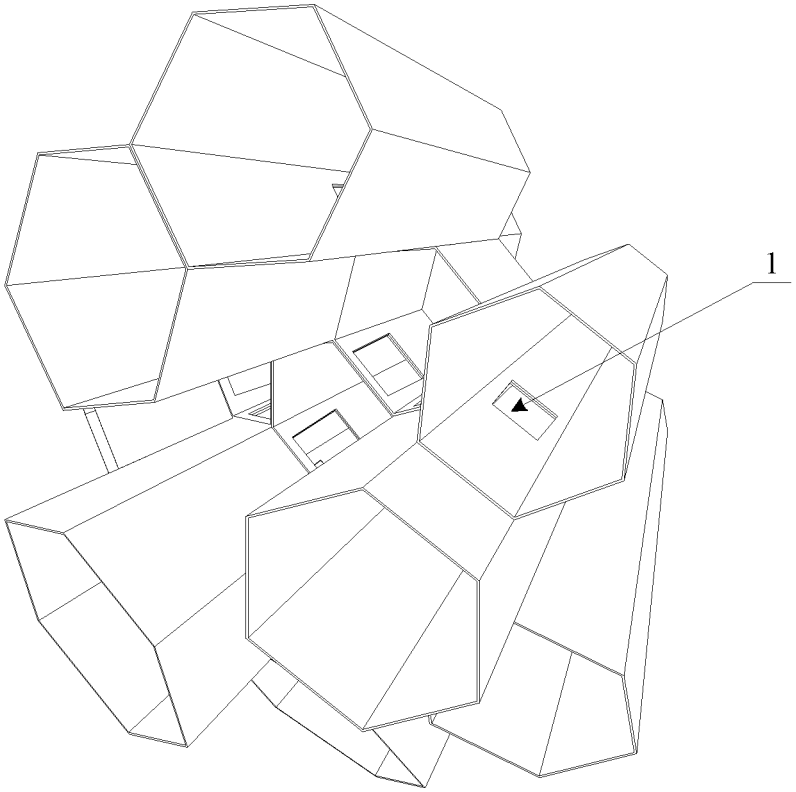
FIG. 19 is a schematic diagram of a spherical combined cabinet provided by a specific embodiment of the present application.

Single cabinets with a cone structure can also be combined into a sphere shape, as shown in FIG. 19. In FIG. 19, adjacent single cabinets are attached to each other by a respective side plate. The two side plates attached to each other are each provided with the first passage opening 1. The first passage opening 1 is configured to communicate two adjacent single cabinets.

Third Embodiment

Figure 21:
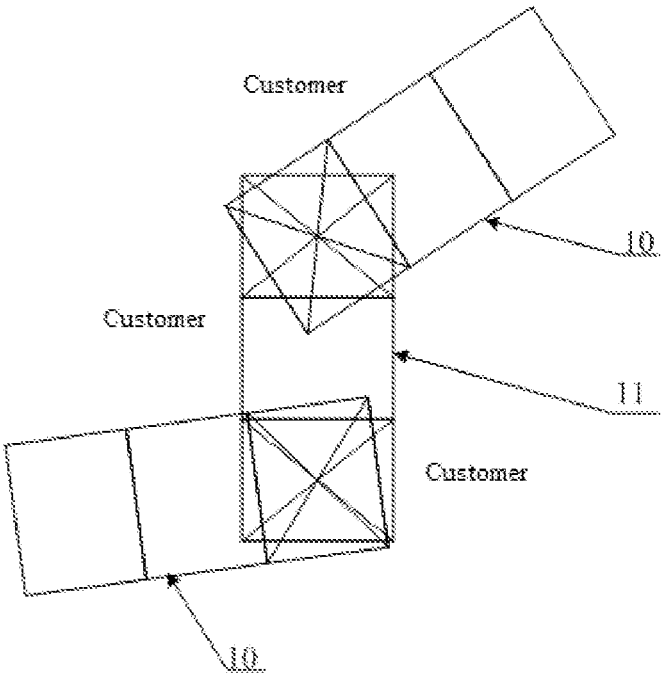
FIG. 21 is a schematic diagram of a corner-shaped combined cabinet provided by a specific embodiment of the present application.

The combined cabinet may also include upper row cabinets 10 and lower row cabinets 11. The upper row cabinets 10 are a row of single cabinets on an upper layer, and the lower row cabinets 11 are a row of single cabinets on a lower layer, as shown in FIG. 21. In FIG. 21, one single cabinet of the upper row cabinets 10 is attached to one single cabinet of the lower row cabinets 11. The two attached single cabinets are communicated with each other through the first passage opening 1. In this way, the upper row cabinets 10 and the lower row cabinets 11 can communicate with each other through the passage opening 1. In addition, the cabinet door of the upper row cabinets 10 is located outside the visual range of the cabinet door of the lower row cabinets 11, and vice versa. With this arrangement, customers can stand in front of the upper row cabinets 10 or the lower row cabinets 11 to select goods, no crowding will occur, and the privacy of customers can be protected.

Furthermore, multiple sets of upper row cabinets 10 are provided. The cabinet door of each set of upper row cabinets 10 is located outside the visible range of other sets of upper row cabinets 10. In this way, even if customers all buy goods from the upper row cabinets 10, there may be no crowding and privacy leakage between them.

Furthermore, multiple sets of lower row cabinets 11 are provided. The cabinet door of each set of lower row cabinets 11 is located outside the visible range of other sets of lower row cabinets 11. In this way, even if customers all buy goods from the lower row cabinets 11, there may be no crowding and privacy leakage between them.

Fourth Embodiment

Figure 20:
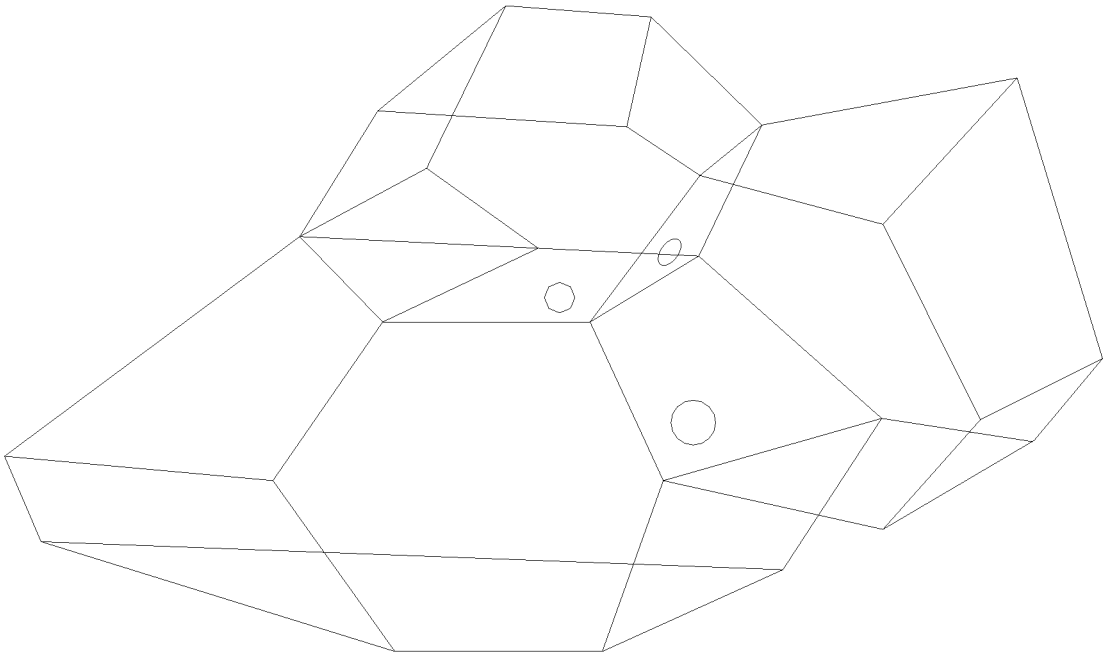
FIG. 20 is a schematic diagram of a gravel-shaped combined cabinet provided by a specific embodiment of the present application.

The combined cabinet may also be assembled into a regular or irregular structure from polyhedral single cabinets. Specifically, the combined cabinet may be gravel-shaped. The gravel-shaped combined cabinet is composed of gravel-shaped single cabinets. Referring to FIG. 20, in FIG. 20, three single cabinets are combined into a gravel-shaped combined cabinet. All three single cabinets are irregular octahedrons. In this specification, there is no specific limitation on the gravel-shaped single cabinet. As long as it is a structure similar to gravel, it falls into the scope of protection of this specification. In FIG. 20, two adjacent single cabinets are attached to each other through their respective side plates. The two side plates which are attached to each other are each provided with the first passage opening 1 for goods to pass through. Thus, the three gravel-shaped single cabinets are communicated with each other.

Furthermore, the single cabinets can be connected by bolts or by clamping. In this specification, there is no specific limitation on the connection method between single cabinets. As long as the connection method can connect the single cabinets into a whole combined cabinet, it falls into the scope of protection of this specification.

Finally, to be further noted, the term "include", "comprise" or any variant thereof is intended to encompass nonexclusive inclusion so that a process, method, article or device including a series of elements includes not only those elements but also other elements which have been not listed definitely or an element(s) inherent to the process, method, article or device. Unless expressively limited, the statement "including a . . . " does not exclude the case that other similar elements may exist in the process, the method, the article or the device other than enumerated elements.

The above embodiments are described in a progressive manner. Each of the embodiments is mainly focused on describing its differences from other embodiments, and reference may be made among these embodiments with respect to the same or similar parts.

According to the above description of the disclosed embodiments, those skilled in the art may implement or practice the present application. Many modifications to these embodiments are apparent to those skilled in the art. The general principles defined herein may be applied to other embodiments without departing from the spirit or scope of the present application. Therefore, the present application should not be limited to the embodiments disclosed herein, but has the widest scope in accordance to the principle and the novel features disclosed herein.

The invention claimed is:

1. A combined cabinet, which is an assembly of single cabinets, wherein two adjacent single cabinets are in communication with each other through a passage opening, and goods in the respective single cabinet are able to enter into the adjacent single cabinet through the passage opening;

a goods storage plate is arranged in each single cabinet, and the goods storage plate is configured to carry goods;

a driving member is arranged on the goods storage plate;

the passage opening comprises a first passage opening, and the first passage opening is located downstream from the driving member; and the driving member is configured to push the goods off the goods storage plate, so that the goods enter the adjacent single cabinet through the first passage opening.

2. The combined cabinet according to claim 1, wherein the combined cabinet is formed by stacking a plurality of single cabinets.

3. The combined cabinet according to claim 2, wherein one end of the goods storage plate in each single cabinet is provided with the first passage opening, or two ends of the goods storage plate are each provided with the first passage openings.

4. The combined cabinet according to claim 2, wherein a plurality of the driving members are arranged side by side.

5. The combined cabinet according to claim 2, wherein a front panel of each single cabinet is transparent, a plurality of layers of the single cabinets are combined into the combined cabinet, and the single cabinets are such arranged that the front panels of the single cabinets are flush with each other, and the front panel of each single cabinet inclines outwards from bottom to top.

6. The combined cabinet according to claim 2, wherein a distance between the driving member and the corresponding single cabinet changes in a driving process.

7. The combined cabinet according to claim 5, wherein a distance between the driving member and the corresponding front panel is constant in a driving process.

8. The combined cabinet according to claim 7, wherein an adjusting plate is arranged in each single cabinet, and the adjusting plate is located downstream from the corresponding driving member and is hinged on the corresponding single cabinet, wherein the adjusting plate is configured to guide the falling goods into the corresponding first passage opening, and the adjusting plate is further configured to adjust a falling speed of the goods by adjusting its own inclination angle.

9. The combined cabinet according to claim 8, wherein two or more combined cabinets are arranged, two adjacent combined cabinets are communicated with each other, and the adjusting plate is further configured to guide the falling goods into the adjacent combined cabinet.

10. The combined cabinet according to claim 1, wherein each single cabinet has a cone structure.

11. The combined cabinet according to claim 1, wherein each single cabinet is polyhedral, and in two adjacent single cabinets, one side plate of one single cabinet is attached to one side plate of the other single cabinet, and the two adjacent single cabinets are communicated with each other through the first passage opening.

12. The combined cabinet according to claim 1, wherein a cabinet door is arranged on a front panel of each single cabinet, and the cabinet door is a transparent glass door or an opaque door.

13. The combined cabinet according to claim 12, wherein the combined cabinet is a corner-shaped combined cabinet and comprises an upper row cabinet and a lower row cabinet, wherein the upper row cabinet and the lower row cabinet are communicated with each other through the first passage opening, the cabinet door of the upper row cabinet is located outside an visible range of the lower row cabinet, and vice versa.

14. The combined cabinet according to claim 1, wherein the goods storage plate is supported by a support rod extending along a driving direction of the driving member, and the goods storage plate is movable along the support rod.

15. The combined cabinet according to claim 1, wherein the passage opening further comprises a second passage opening arranged on an extension line of the driving member, and the driving member is configured to push the goods into the adjacent single cabinet through the second passage opening.

16. The combined cabinet according to claim 1, wherein an automatic shutter is provided at the first passage opening, and the automatic shutter is configured to open or close the first passage opening.

17. The combined cabinet according to claim 16, wherein the automatic shutter is hinged at the first passage opening, and further plays a guiding role for goods passing through the first passage opening.

18. The combined cabinet according to claim 16, wherein a middle part of the automatic shutter is hinged in the first passage opening, and one side of the automatic shutter is hinged to one side of the first passage opening.

19. The combined cabinet according to claim 1, wherein the combined cabinet is a regular body or an irregular body.

* * * * *